US005230284A

United States Patent [19]

Kelm

[11] Patent Number: 5,230,284

[45] Date of Patent: Jul. 27, 1993

[54] MECHANISM FOR ADJUSTING FORME ROLLERS AT THE PLATE CYLINDER OF A ROTARY PRINTING MACHINE

[75] Inventor: Carsten Kelm, Mannhein, Fed. Rep. of Germany

[73] Assignee: Heidelberger Druckmaschinen AG, Heidelberg, Fed. Rep. of Germany

[21] Appl. No.: 934,427

[22] Filed: Aug. 24, 1992

[30] Foreign Application Priority Data

Aug. 31, 1991 [DE] Fed. Rep. of Germany ... 9110806[U]

[51] Int. Cl.[5] ..... B41F 31/34; B41F 31/36

[52] U.S. Cl. ..... 101/352; 101/247

[58] Field of Search ..... 101/352, 351, 247, 349, 101/350, 209, 216, 218, 139, 140, 143, 144, 185; 118/256, 258

[56] References Cited

U.S. PATENT DOCUMENTS 3,366,047 1/1968 Hermach et al. .

3,691,956 9/1972 James et al. ..... 101/247

4,458,591 7/1984 Guarald ..... 101/352

FOREIGN PATENT DOCUMENTS 1611251 3/1972 Fed. Rep. of Germany .

169252 7/1986 Japan ..... 101/352

8471 of 1915 United Kingdom ..... 101/352

*Primary Examiner*—J. Reed Fisher

*Attorney, Agent, or Firm*—Nils H. Ljungman & Associates

[57] ABSTRACT

A mechanism for adjusting forme rollers at a plate cylinder of a rotary printing machine. The forme rollers are mounted via bearing levers so as to pivot about distributor rollers and so as to be engageable with and disengageable from the plate cylinder, respectively. As a means for supporting and adjusting the forme rollers, a respective sliding member on which an intermediate lever rests is assigned to a reference ring, an adjusting screw screwed into bearing lever being supported on the intermediate lever, the bearing levers being actuatable via cylinders subjected to a pressure medium.

20 Claims, 3 Drawing Sheets 24
25
23
22
2
3
4
5
7
6
8
9
26
20
19
18
21
17
28
16
15
14
1
13
11
10
12

MECHANISM FOR ADJUSTING FORME ROLLERS AT THE PLATE CYLINDER OF A ROTARY PRINTING MACHINE

BACKGROUND OF THE INVENTION

1. Field of the Invention:

The present invention relates to a device for adjusting the forme rollers at the plate cylinder of a rotary printing machine, a device in which the forme rollers are mounted so that they can be pivoted, via bearing levers, about distributor rollers and can be engaged with and disengaged from the plate cylinder. Means are provided for adjusting the distance between forme rollers and plate cylinder, and are configured for following a change in position of the plate cylinder, without influencing the distance between the plate cylinder and the forme rollers, by utilizing a reference ring which is provided centrically, or generally concentrically, with respect to the plate cylinder. The reference ring follows the changes in position of the plate cylinder and on which the forme rollers are supported thereupon by means for adjusting the forme rollers.

2. Background Information:

In a known embodiment of the type described, as disclosed in Federal Republic of Germany Patent No. 16 11 251, which corresponds to U.S. Pat. No. 3,366,047a plate supported on the reference ring is assigned to each forme roller. Adjusting screws which are provided for adjusting the plate and thus the forme roller permit an adjustment of the forme roller with respect to the plate cylinder after having released the plate. Such a bearing is not stable in itself and features a play so that it does not ensure a highly precise adjustment of the forme rollers.

OBJECT OF THE INVENTION

On the basis of this known arrangement, it is the object of the present invention to provide a very precise adjusting device for the forme rollers which follows each change in position, even the cocking of the plate cylinder, without influencing the respective adjustment of the forme rollers.

SUMMARY OF THE INVENTION

According to the present invention this and other objects are achieved in that, as a means for adjusting the forme rollers, a sliding member, on which an intermediate lever rests, is preferably assigned to each reference ring. Preferably, an adjusting screw is screwed into the bearing lever and is supported on the intermediate lever, the bearing levers being actuatable, or biasable, by cylinders subjected to a pressure medium. Essentially, this solution makes it possible to mount the forme roller in the bearing levers via highly precise bearings each of which, for example, can be adjusted via an eccentric bearing, a worm and a worm gear. In this manner, the forme roller can essentially be precisely adjusted with respect to the distributor roller cooperating therewith. The supporting and adjusting means, too, essentially provide a highly precise mounting by means of which the forme roller is precisely adjustable with respect to the plate cylinder. By actuating the cylinders subjected to a pressure medium, substantially every play is excluded in the engaged position so that the forme roller can be adjusted without play with respect to the plate cylinder.

In an advantageous embodiment of the present invention, the sliding member can be fastened to a frame element, and the intermediate lever can be mounted on the bearing lever. In this case, the position of the sliding member is not changed with respect to the reference ring, whereas the intermediate lever may follow the motion of the bearing lever, thus ensuring its contact position with the sliding member.

According to a further embodiment of the present invention, the sliding member features a head on which the intermediate lever is supported. The head may compensate for a lateral displacement of the working point of the lever to permit a very flexible application.

Furthermore, a notched spindle and an adjusting spindle are preferably assigned to the adjusting screw so that the adjustment may be effected by the machine from a favorable position, without the adjustment changing automatically.

In summary, one aspect of the invention resides broadly in a mechanism for adjusting a forme roller at a plate cylinder of a rotary printing machine, the plate cylinder having a longitudinal axis and being mounted for rotation thereabout on the rotary printing machine, the forme roller having a longitudinal axis and being mounted for rotation thereabout on a bearing lever, the bearing lever being displaceable for varying the distance between the forme roller and the plate cylinder, the apparatus comprising: a reference ring being mounted with the plate cylinder and being configured to follow movement of the longitudinal axis of the plate cylinder and be displaced in response thereto; a sliding pin extending from and contacting the reference ring, mounted for being displaced in response to the displacement of the reference ring; an intermediate lever being displaceably mounted, contacting the sliding pin, and being configured for being displaced in response to the displacement of the sliding pin; an adjusting screw extending from and contacting the intermediate lever, the adjusting screw being connected to the bearing lever, the adjusting screw being configured to displace the bearing lever in response to the displacement of the intermediate lever, such that the longitudinal axis of the forme roller displaces in response to the movement of the longitudinal axis of the plate cylinder; and the adjusting screw being adjustable, relative to the intermediate lever, to vary the position of the bearing lever to predetermine a positional relationship between the forme roller and the plate cylinder.

Another aspect of the invention resides broadly in apparatus for adjusting a forme roller at a plate cylinder of a rotary printing machine, the plate cylinder having a longitudinal axis and being mounted for rotation on the rotary printing machine about the longitudinal axis of the plate cylinder, the forme roller having being rotatably mounted on a displaceable frame, the displaceable frame being displaceable for varying the distance between the forme roller and the plate cylinder, the apparatus comprising: reference means being mounted with the plate cylinder and being configured to follow movement of the longitudinal axis of the plate cylinder and be displaced in response thereto; a displaceable member extending from the reference means mounted for being displaced in response to the displacement of the reference means; intermediate lever means being displaceably mounted and being configured for being displaced in response to the displacement of the displaceable member; and connection means extending from the intermediate lever means, the connection means being connected to the displaceable frame, the connection means being configured to displace the displaceable frame in response to the displacement of the intermediate lever means.

Yet another aspect of the invention resides broadly in apparatus for adjusting a forme roller at a plate cylinder of a rotary printing machine, the plate cylinder having a longitudinal axis and being mounted for rotation on the rotary printing machine about the longitudinal axis of the plate cylinder, the forme roller having being rotatably mounted on a displaceable frame, the displaceable frame being displaceable for varying the distance between the forme roller and the plate cylinder, the apparatus comprising: a displaceable member being configured to follow movement of the longitudinal axis of the plate cylinder and be displaced in response thereto; intermediate lever means being displaceably mounted and being configured for being displaced in response to the displacement of the displaceable member; connection means extending from the intermediate lever means, the connection means being connected to the displaceable frame, the connection means being configured to displace the displaceable frame in response to the displacement of the intermediate lever means; and the connection means being adjustable, relative to the intermediate lever means, to vary the position of the displaceable frame to predetermine a positional relationship between the forme roller and the plate cylinder.

BRIEF DESCRIPTION OF THE DRAWINGS

A specimen embodiment of the invention is schematically illustrated in the drawings, wherein.

DESCRIPTION OF THE PREFERRED EMBODIMENTS

Figure 1:
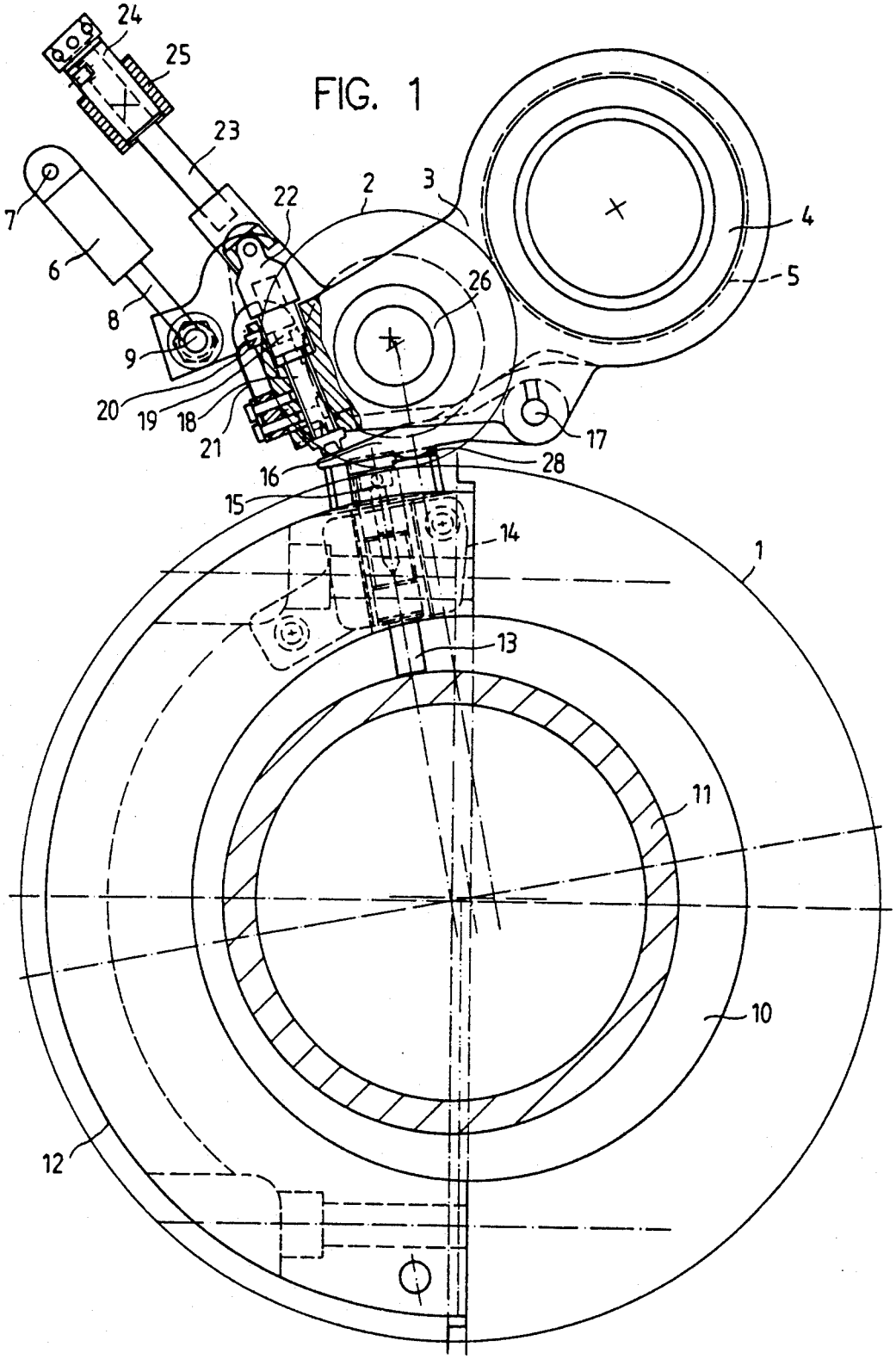
FIG. 1 is a side view of the adjusting arrangement.

In a known manner, forme rollers 2, which may be provided for the application of dampening medium or ink, or both, are assigned to the plate cylinder 1 of a rotary printing machine. The forme rollers 2 may be mounted, at both ends thereof, in bearing levers 3 which, in turn, are pivotable about the bearings 4 of distributor rollers 5 being assigned to, or selectively engageable with, the form rollers 2. For example, an adjusting arrangement designed as a pneumatic cylinder 6 which, via a bolt 7, is fastened to the machine side frame, may be used for the engagement of the forme rollers 2 with the plate cylinder 1 and their disengagement therefrom, and possibly also for the biasing of form rollers 2 onto plate cylinder 1. Other known biasing arrangements may also be used. In the specimen embodiment illustrated in FIG. 1, the piston rod 8 preferably acts on the bearing lever 3 via a screw connection 9, so that the forme roller 2 may be engaged with or disengaged from the plate cylinder, or biased thereonto, by actuating the pneumatic cylinder 6.

At the bearing 10 of the plate cylinder 1, which bearing may be designed eccentrically, in a known manner, for the adjustment of the plate cylinder, a reference ring 11 is provided. Reference ring 11 is preferably mounted centrically, coaxially or concentrically, with respect to the plate cylinder and follows the changes in position of the plate cylinder, the bearing 10 being adjustably secured in the machine frame element 12. Eccentric bearings for cylinders are well-known and are discussed, for example, in U.S. Pat. No. 3,336,047 to Hermach et al. In the specimen embodiment shown, a sliding member 13, which is mounted on a bearing body 14 which, in turn, is fastened to the frame element 12, is preferably supported on the reference ring 11. On the side of the sliding member which is opposite the reference ring 11 there is preferably provided a head 15 projecting into the area of an intermediate lever 16. Via a bolt 17, the intermediate lever 16 is preferably pivot-mounted on the bearing lever 3. Sliding member 13 is preferably in the form of a slidable pin.

In a front area of the bearing lever 3, an adjusting screw 18 which, on one side thereof, is supported on the intermediate lever 16 is preferably screwed into a thread. On the opposite side, the adjusting screw 18 preferably features a notched surface 19 with which a notch 20 engages. The notch 20 is preferably pressed or biased onto the notched surface 19 by means of a leaf spring 21, thus substantially eliminating an unintended adjusting of the adjusting screw 18. Next to the notched surface 19, a joint coupling 22, with which an adjusting spindle 23 engages, is preferably attached to the adjusting screw 18. The adjusting spindle 23 is preferably connected to an adjusting element 24 which is mounted on a bearing body 25 provided at the frame element 12. By turning the adjusting element 24, the adjusting screw 18 may be turned so that, via the intermediate lever 16 and the sliding member 13, the distance between the outer cylindrical surface of the plate cylinder 1 and the outer cylindrical surface of the forme roller 2 can be set precisely.

Further refinements of the present invention will be appreciated from FIG. 1. Particularly, intermediate lever 16 is preferably configured such that its fulcrum, at bolt 17, is located essentially at an extreme end of lever 16. Sliding member 13 preferably extends in a direction parallel to a radial direction of the plate cylinder 1 and, thus, preferably contacts reference ring 11 essentially perpendicularly.

As shown, adjustment screw 18 preferably extends in an orientation which is offset at a generally small acute angle with respect to the orientation of sliding member 13. Intermediate lever 16 is preferably shaped such that both sliding member 13 and adjustment screw 18 each meet the surface of the lever perpendicularly. Thus, an upper face of intermediate lever 16, where adjustment screw 18 meets the lever, is preferably sloped with respect to a lower face of the lever, where sliding member 13 meets the lever. Also, sliding member 13 preferably meets intermediate lever 16 at an area closer to bolt 17, or the fulcrum of intermediate lever 16, than the area at which adjustment screw 18 meets the intermediate lever 16.

As can also be appreciated from FIG. 1, reference ring 11 preferably has a diameter notably smaller than that of plate cylinder 1, preferably on a scale similar to that depicted in FIG. 1.

Figure 2:
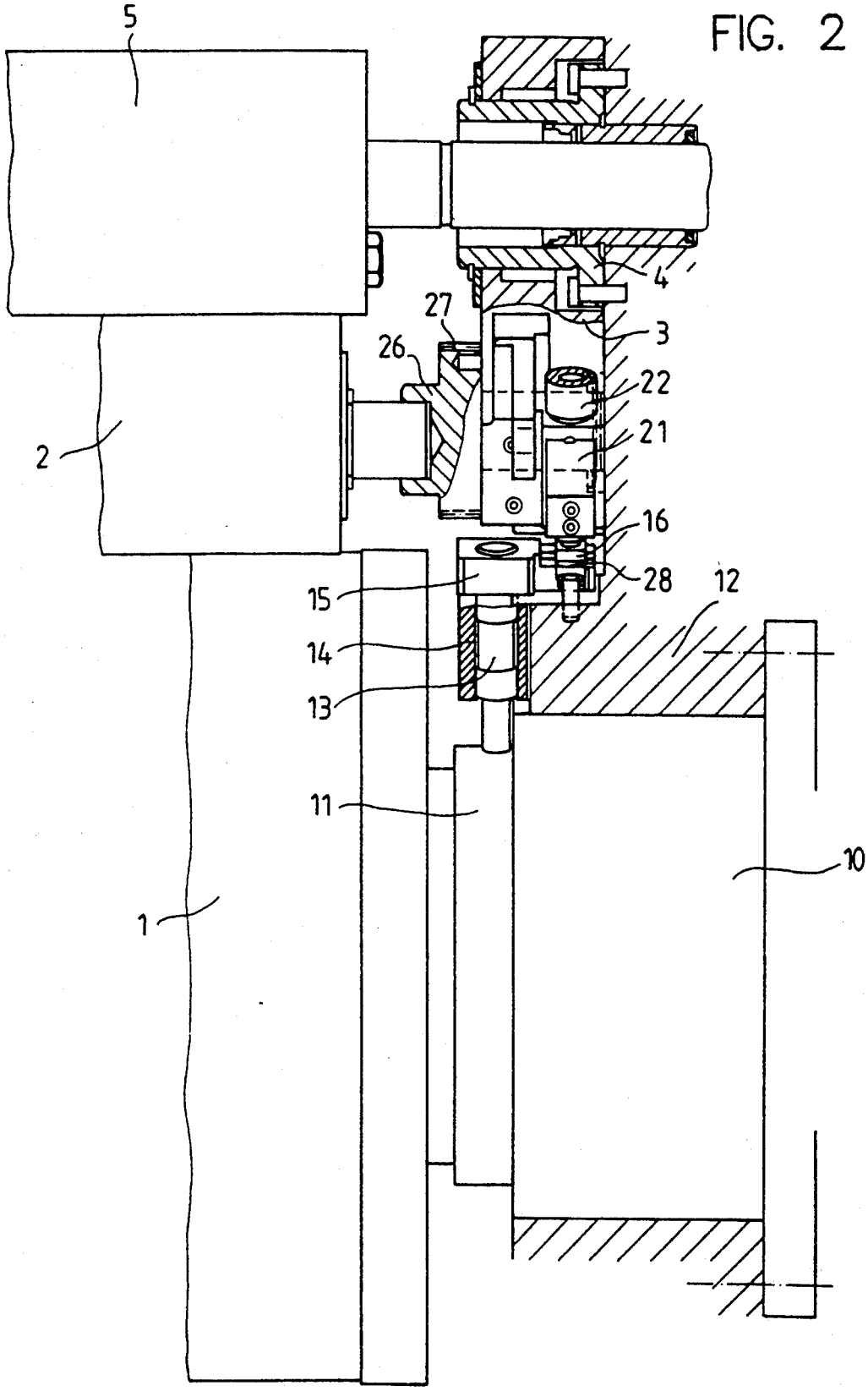
FIG. 2 is a partial cross section taken through the adjusting means at line 1.1.

In the specimen embodiment shown in FIG. 2, the forme roller 2 is preferably mounted in an eccentric bearing 26 which is fastened to the bearing lever 3 and can be adjusted very precisely with respect to the distributor roller 4 via a worm and a worm gear (not illustrated). Worm gears are well-known and are discussed, for example, in U.S. Pat. No. 4,700,597 to Taguchi, which issued on Oct. 20, 1987. The solution of the invention also permits a very precise adjustment of the forme roller 2 with respect to the plate cylinder 1, wherein the engagement of the forme roller with the plate cylinder ensures a substantially play-free adjustment via a cylinder 6 subjected to a pressure medium. By using the head 15 and the intermediate lever 16, a lateral displacement may be compensated for. Due to an arcuate supporting surface 28 provided at the intermediate lever 16, the intermediate lever may follow the bearing lever 3 motion, ensuring a substantially exact position of contact.

Figure 3:
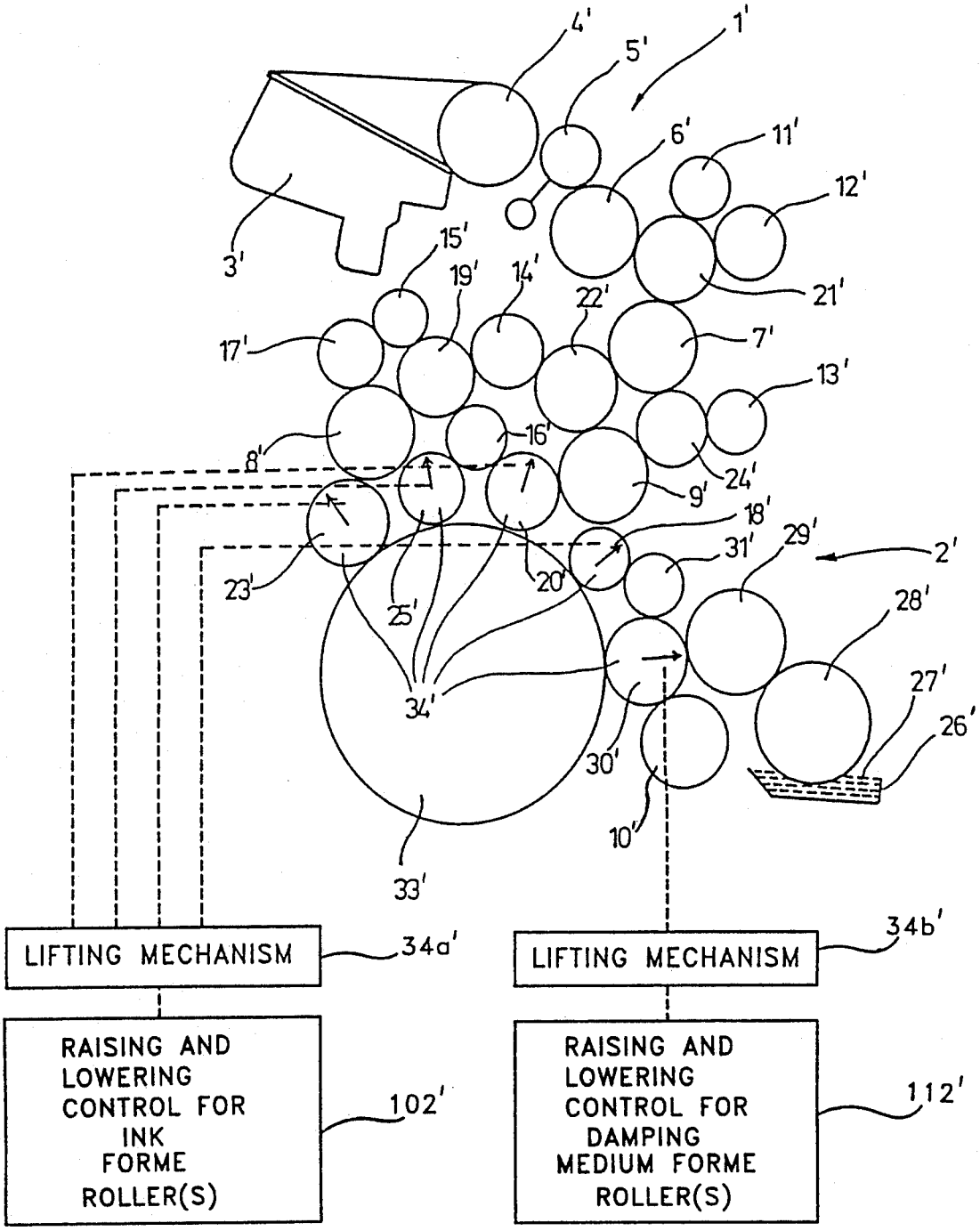
FIG. 3 is a schematic illustration of an offset rotary printing press in which the present invention may be employed.

FIG. 3 is a schematic illustration of an offset rotary printing press in which the present invention may be employed and particularly illustrates the possible locations of forme rollers. In a known manner, an inking unit 1' and damping unit 2' are provided. Inking unit 1' includes ink fountain 3' and ink fountain roller 4'. A vibrator roller 5' connects ink fountain roller 4' and a first inking unit roller 6'. Other inking unit rollers are indicated at 7', 8', 9', 11'–17', 19', 21', 22' and 24'. Damping unit 2' typically includes reservoir 26', for holding damping medium 27', and rollers 28', 29', 31' and 10'.

Forme rollers are generally indicated at 34'. The forme rollers 34' are all engageable with plate cylinder 33'. Ink forme rollers are indicated at 20', 23' and 25' and are configured for transferring ink from the inking unit rollers to the printing plate cylinder 33'. Another forme roller, which may transfer both damping medium and ink to the plate cylinder, is indicated at 18'. Finally, a damping medium forme roller, for transferring damping medium to the printing plate cylinder 33', is indicated at 30'.

Schematically illustrated are mechanisms for lifting forme rollers 34' off from the plate cylinder 33'. As an example, one lifting mechanism **34*a*' may be provided for selectively engaging and disengaging ink forme rollers 20', 23' and 25', and possibly also forme roller 18', from the plate cylinder 33'. Another lifting mechanism 34*b*' may be provided for selectively engaging and disengaging damping unit forme roller 30' from the plate cylinder 33'. Lifting mechanisms 34*a*' and 34*b*' may each be provided, respectively, with raising and lowering control arrangements 102' and 112'**. Such arrangements for lifting forme rollers away from plate cylinders are well-known and are discussed, for example, in U.S. Pat. No. 5,081,926 to Rodi, which issued on Jan. 21, 1991, and in U.S. Pat. No. 3,869,983 to Garber, entitled "Variable Repeat-length Web Press".

One feature of the invention resides broadly in a device for adjusting forme rollers at a plate cylinder of a rotary printing machine in which, via bearing levers, the forme rollers are mounted so as to pivot about distributor rollers and so as to be engageable with and disengageable from the plate cylinder, respectively, comprising means for adjusting the distance between forme rollers and plate cylinder, the means following a change in position of the plate cylinder—without influencing the distance between plate cylinder and forme rollers—by using a reference ring which is provided centrically with respect to the plate cylinder, which follows the changes in position of the plate cylinder and on which the forme rollers are supported via the means for adjusting the forme rollers, characterized in that, as a means for supporting and adjusting the forme rollers 2, a respective sliding member 13 on which an intermediate lever 16 rests is assigned to a reference ring 11, an adjusting screw 18 screwed into bearing lever 3 being supported on the intermediate lever 16, the bearing levers 3 being actuatable via cylinders 6 subjected to a pressure medium.

Another feature of the invention resides broadly in a device characterized in that the sliding member 13 is fastened to a frame element 12 and that the intermediate lever 16 is mounted on the bearing lever 3.

Yet another feature of the invention resides broadly in a device characterized in that the sliding member 13 features a head 15 on which the intermediate lever 16 is supported.

Another feature of the invention resides broadly in a device characterized in that a notch 20 and an adjusting spindle are assigned to the adjusting screw 18.

All, or substantially all, of the components and methods of the various embodiments may be used in any combination with at least one embodiment or all of the embodiments, if any, described herein.

All of the patents, patent applications and publications recited herein, if any, are hereby incorporated by reference as if set forth in their entirety herein.

The details in the patents, patent applications and publications may be considered to be incorporable, at applicant's option, into the claims during prosecution as further limitations in the claims to patentably distinguish any amended claims from any applied prior art.

The appended drawings, in their entirety, including all dimensions, proportions and/or shapes in at least one embodiment of the invention, are, if applicable, accurate and to scale and are hereby incorporated by reference into this specification.

The invention as described hereinabove in the context of the preferred embodiments is not to be taken as limited to all of the provided details thereof, since modifications and variations thereof may be made without departing from the spirit and scope of the invention.

LIST OF REFERENCE NUMERALS FOR FIGS. 1 AND 2

1: plate cylinder
2: forme roller
3: bearing lever
4: bearing
5: distributor roller
6: pneumatic cylinder
7: bolt
8: piston rod
9: screw connection
10: bearing
11: reference ring
12: frame element
13: sliding member
14: bearing body
15: head
16: intermediate lever
17: bolt
18: adjusting screw
19: notched surface
20: notch
21: leaf spring
22: joint coupling
23: adjusting spindle
24: adjusting element
25: bearing body
26: eccentric bearing
27: worm gear
28: supporting surface.

What is claimed is:

1. Apparatus for adjusting a forme roller at a plate cylinder of a rotary printing machine, the plate cylinder having a longitudinal axis and being mounted for rotation thereabout on the rotary printing machine, the forme roller having a longitudinal axis and being mounted for rotation thereabout, said apparatus comprising:

a lever, the forme roller for being rotatably mounted on said lever;

said lever being displaceable for varying the distance between the forme roller and the plate cylinder;

a reference ring for being mounted with the plate cylinder and being configured to follow movement of the longitudinal axis of the plate cylinder and be displaced in response thereto;

a slidable pin extending from and contacting said reference ring, mounted for being displaced in response to the displacement of said reference ring;

said reference ring providing a reference for said slidable pin;

an intermediate lever being displaceably mounted, contacting said slidable pin, and being configured for being displaced in response to the displacement of said slidable pin;

an adjusting screw extending from and contacting said intermediate lever, said adjusting screw being connected to said lever, said adjusting screw being configured to displace said lever in response to the displacement of said intermediate lever, such that the longitudinal axis of the forme roller displaces in response to the movement of the longitudinal axis of the plate cylinder;

said adjusting screw being adjustable, relative to said intermediate lever, to vary the position of said lever to predetermine a positional relationship between the forme roller and the plate cylinder;

means for holding said slidable pin, said holding means being disposed between said reference ring and said intermediate lever;

said slidable pin having a longitudinal axis and being slidable, along its longitudinal axis, within said holding means; and said slidable pin being disposed to extend with its longitudinal axis substantially parallel to a radial direction of the plate cylinder, said slidable pin being slidable, substantially within said holding means, in the radial direction of the plate cylinder.

2. The apparatus according to claim 1, further comprising means for biasing the forme roller towards the plate cylinder.

3. The apparatus according to claim 2, wherein the apparatus is configured for maintaining the predetermined positional relationship between the forme roller and the plate cylinder during movement of the longitudinal axis of the plate cylinder.

4. The apparatus according to claim 3, wherein said adjusting screw is screwed into said lever.

5. The apparatus according to claim 4, wherein said biasing means comprises a hydraulic cylinder.

6. The apparatus according to claim 5, wherein the rotary printing machine further includes at least one distributor roller being engageable with the forme roller, and the plate cylinder has a diameter, said apparatus further comprising:

said holding means comprising a frame element;

said lever for being pivotally mounted about one of the at least one distributor roller;

said intermediate lever being pivotally mounted on said lever;

said slidable pin having a head portion, said intermediate lever for being supported on said head portion;

said adjusting screw comprising a notched spindle and an adjusting spindle, said notched spindle and said adjusting spindle being configured for holding in place said adjusting screw;

said reference ring being mounted coaxially with respect to the plate cylinder;

said reference ring being a ring having a diameter less than that of the plate cylinder;

the plate cylinder being mounted in an eccentric bearing;

said adjusting screw comprising a notch and a notched surface, said notched surface for being engaged with said notch;

leaf spring means for biasing said notch towards said notched surface;

an adjusting element being connected to said adjusting spindle;

said adjusting element being configured for turning said adjusting screw for predetermining the positional relationship between the forme roller and the plate cylinder;

said intermediate lever being pivotable about a bolt, said bolt being disposed towards an end of said intermediate lever;

said slidable pin being configured for contacting said reference ring generally perpendicularly;

said adjusting screw extending in an orientation offset at a generally small acute angle with respect to the orientation of said slidable pin;

said intermediate lever having an upper face, contacting said adjusting screw and a lower face, contacting said slidable pin;

said upper face of said intermediate lever being sloped with respect to said lower face of said intermediate lever, such that said slidable pin meets said lower face generally perpendicularly and that said adjusting screw meets said upper face generally perpendicularly; and said slidable pin meeting said intermediate lever at an area along said intermediate lever closer to said bolt than an area where said adjusting screw meets said intermediate lever.

7. The apparatus according to claim 1, wherein said slidable pin is disposed within said holding means to contact said reference ring generally perpendicularly.

8. The apparatus according to claim 7, wherein the plate cylinder has a diameter, said apparatus further comprising:

said reference ring having a central axis, the central axis of said reference ring being coaxial with respect to the longitudinal axis of the plate cylinder; and said reference ring being a ring defined about the central axis and having a diameter less than the diameter of the plate cylinder.

9. The apparatus according to claim 8, further comprising means for biasing the forme roller towards the plate cylinder.

10. The apparatus according to claim 9, wherein the apparatus is configured for maintaining the predetermined positional relationship between the forme roller and the plate cylinder during movement of the longitudinal axis of the plate cylinder.

11. The apparatus according to claim 10, wherein said adjusting screw is screwed into said lever.

12. The apparatus according to claim 11, wherein said biasing means comprises a hydraulic cylinder.

13. The apparatus according to claim 12, wherein the rotary printing machine further includes at least one distributor roller being engageable with the forme roller, said apparatus further comprising:

said holding means comprising a frame element;

said lever for being pivotally mounted about one of the at least one distributor roller;

said intermediate lever being pivotally mounted on said lever;

said slidable pin having a head portion, said intermediate lever for being supported on said head portion;

said adjusting screw comprising a notched spindle and an adjusting spindle, said notched spindle and said adjusting spindle being configured for holding in place said adjusting screw;

the plate cylinder being mounted in an eccentric bearing;

said adjusting screw comprising a notch and a notched surface, said notched surface for being engaged with said notch;

leaf spring means for biasing said notch towards said notched surface;

an adjusting element being connected to said adjusting spindle;

said adjusting element being configured for turning said adjusting screw for predetermining the positional relationship between the forme roller and the plate cylinder;

said intermediate lever being pivotable about a bolt, said bolt being disposed towards an end of said intermediate lever;

said adjusting screw extending in an orientation offset at a generally small acute angle with respect to the orientation of said slidable pin;

said intermediate lever having an upper face, contacting said adjusting screw and a lower face, contacting said slidable pin;

said upper face of said intermediate lever being sloped with respect to said lower face of said intermediate lever, such that said slidable pin meets said lower face generally perpendicularly and that said adjusting screw meets said upper face generally perpendicularly; and said slidable pin meeting said intermediate lever at an area along said intermediate lever closer to said bolt than an area where said adjusting screw meets said intermediate lever.

14. The apparatus according to claim 1, further comprising:

means for biasing the forme roller towards the plate cylinder; and said biasing means being actuable to vary the biasing of the forme roller.

15. The apparatus according to claim 14, wherein said biasing means comprises a hydraulic cylinder.

16. The apparatus according to claim 15, wherein the apparatus is configured for maintaining the predetermined positional relationship between the forme roller and the plate cylinder during movement of the longitudinal axis of the plate cylinder.

17. The apparatus according to claim 16, wherein said adjusting screw is screwed into said lever.

18. The apparatus according to claim 17, wherein the rotary printing machine further includes at least one distributor roller being engageable with the forme roller, and the plate cylinder has a diameter, said apparatus further comprising:

said holding means comprising a frame element;

said lever for being pivotally mounted about one of the at least one distributor roller;

said intermediate lever being pivotally mounted on said lever;

said slidable pin having a head portion, said intermediate lever for being supported on said head portion;

said adjusting screw comprising a notched spindle and an adjusting spindle, said notched spindle and said adjusting spindle being configured for holding in place said adjusting screw;

said reference ring being mounted coaxially with respect to the plate cylinder;

said reference ring being a ring having a diameter less than that of the plate cylinder;

the plate cylinder being mounted in an eccentric bearing;

said adjusting screw comprising a notch and a notched surface, said notched surface for being engaged with said notch;

leaf spring means for biasing said notch towards said notched surface;

an adjusting element being connected to said adjusting spindle;

said adjusting element being configured for turning said adjusting screw for predetermining the positional relationship between the forme roller and the plate cylinder;

said intermediate lever being pivotable about a bolt, said bolt being disposed towards an end of said intermediate lever;

said slidable pin being configured for contacting said reference ring generally perpendicularly;

said adjusting screw extending in an orientation offset at a generally small acute angle with respect to the orientation of said slidable pin;

said intermediate lever having an upper face, contacting said adjusting screw and a lower face, contacting said slidable pin;

said upper face of said intermediate lever being sloped with respect to said lower face of said intermediate lever, such that said slidable pin meets said lower face generally perpendicularly and that said adjusting screw meets said upper face generally perpendicularly; and said slidable pin meeting said intermediate lever at an area along said intermediate lever closer to said bolt than an area where said adjusting screw meets said intermediate lever.

19. A rotary printing machine comprising:

a plate cylinder, said plate cylinder having a longitudinal axis and being mounted for rotation thereabout;

a forme roller being engageable with said plate cylinder, said forme roller having a longitudinal axis and being mounted for rotation thereabout;

apparatus for adjusting said forme roller at said plate cylinder, said apparatus comprising:

a lever, said forme roller being rotatably mounted on said lever;

said lever being displaceable for varying the distance between said forme roller and said plate cylinder;

a reference ring being mounted with said plate cylinder and being configured to follow movement of the longitudinal axis of said plate cylinder and be displaced in response thereto;

a slidable pin extending from and contacting said reference ring, mounted for being displaced in response to the displacement of said reference ring;

said reference ring providing a reference for said slidable pin;

an intermediate lever being displaceably mounted, contacting said slidable pin, and being configured for being displaced in response to the displacement of said slidable pin;

an adjusting screw extending from and contacting said intermediate lever, said adjusting screw being connected to said lever, said adjusting screw being configured to displace said lever in response to the displacement of said intermediate lever, such that the longitudinal axis of said forme roller displaces in response to the movement of the longitudinal axis of said plate cylinder;

said adjusting screw being adjustable, relative to said intermediate lever, to vary the position of said lever to predetermine a positional relationship between said forme roller and said plate cylinder;

means for holding said slidable pin, said holding means being disposed between said reference ring and said intermediate lever;

said slidable pin having a longitudinal axis and being slidable, along its longitudinal axis, within said holding means; and said slidable pin being disposed to extend with its longitudinal axis substantially parallel to a radial direction of said plate cylinder, said slidable pin being slidable, substantially within said holding means, in the radial direction of said plate cylinder.

20. The printing machine according to claim 19, further comprising:

said slidable pin being disposed within said holding means to contact said reference ring generally perpendicularly;

said plate cylinder having a diameter;

said reference ring having a central axis, the central axis of said reference ring being coaxial with respect to the longitudinal axis of said plate cylinder;

said reference ring being a ring defined about the central axis and having a diameter less than the diameter of said plate cylinder;

means for biasing said forme roller towards said plate cylinder;

said biasing means being actuable to vary the biasing of said forme roller;

said biasing means comprising a hydraulic cylinder;

said apparatus being configured for maintaining the predetermined positional relationship between said forme roller and said plate cylinder during movement of the longitudinal axis of said plate cylinder;

said adjusting screw being screwed into said lever;

at least one distributor roller being engageable with said forme roller said apparatus further comprising:

said holding means comprising a frame element;

said lever being pivotally mounted about one of said at least one distributor roller;

said intermediate lever being pivotally mounted on said lever;

said slidable pin having a head portion, said intermediate lever for being supported on said head portion;

said adjusting screw comprising a notched spindle and an adjusting spindle, said notched spindle and said adjusting spindle being configured for holding in place said adjusting screw;

said reference ring being a ring having a diameter less than that of said plate cylinder;

said plate cylinder being mounted in an eccentric bearing;

said adjusting screw comprising a notch and a notched surface, said notched surface for being engaged with said notch;

leaf spring means for biasing said notch towards said notched surface;

an adjusting element being connected to said adjusting spindle;

said adjusting element being configured for turning said adjusting screw for predetermining the positional relationship between said forme roller and said plate cylinder;

said intermediate lever being pivotable about a bolt, said bolt being disposed towards an end of said intermediate lever;

said adjusting screw extending in an orientation offset at a generally small acute angle with respect to the orientation of said slidable pin;

said intermediate lever having an upper face, contacting said adjusting screw and a lower face, containing said slidable pin;

said upper face of said intermediate lever being sloped with respect to said lower face of said intermediate lever, such that said slidable pin meets said lower face generally perpendicularly and that said adjusting screw meets said upper face generally perpendicularly; and said slidable pin meeting said intermediate lever at an area along said intermediate lever closer to said bolt than an area where said adjusting screw meets said intermediate lever.

* * * * *

UNITED STATES PATENT AND TRADEMARK OFFICE

CERTIFICATE OF CORRECTION

PATENT NO. : 5,230,284

DATED : July 27, 1993

INVENTOR(S) : Carsten KELM

It is certified that error appears in the above-indentified patent and that said Letters Patent is hereby corrected as shown below:

On the title page: item 75, in the Inventor section, after 'Kelm,', delete "Mannhein" and insert --Mannheim--.

In column 12, lines 45 and 46, Claim 20, after 'face,', delete "containing" and insert --contacting--.

Signed and Sealed this

First Day of March, 1994

Bruce Lehman

BRUCE LEHMAN

*Commissioner of Patents and Trademarks*

*Attest:*

*Attesting Officer*